United States Patent [19]

Kellogg et al.

[11] 4,430,072

[45] Feb. 7, 1984

[54] CENTRIFUGE ASSEMBLY

[75] Inventors: Robert M. Kellogg, Endwell; Victor R. Kruger, Apalachin; Alfred P. Mulzet, Endicott, all of N.Y.

[73] Assignee: International Business Machines Corporation, Armonk, N.Y.

[21] Appl. No.: 803,007

[22] Filed: Jun. 3, 1977

[51] Int. Cl.[3] ..... B04B 7/08

[52] U.S. Cl. ..... 494/45

[58] Field of Search ..... 233/1 R, 1 A, 1 D, 14 R, 233/14 A, 19 R, 26, 27, 28; 494/45

[56] References Cited

U.S. PATENT DOCUMENTS

| | | | |
|---|---|---|---|
| 3,244,363 | 4/1966 | Hein | 233/1 R |
| 3,858,796 | 1/1975 | Unger et al. | 233/27 |
| 3,864,089 | 2/1975 | Tiffany et al. | 233/28 X |
| 3,987,961 | 10/1976 | Sinn et al. | 233/27 |
| 4,007,871 | 2/1977 | Jones et al. | 233/27 |

*Primary Examiner*—George H. Krizmanich
*Attorney, Agent, or Firm*—Sughrue, Mion, Zinn, Macpeak and Seas

[57] ABSTRACT

An improved centrifuge assembly comprising a channeled rotor assembly and a ring-like fluid container disposed in the channel, whereby the centrifugal separation effects in the fluid container are determined by the geometry of the channel in the rotor. The fluid container is preferably formed from semirigid plastic material in the form of a tube having a rectangular cross section and is considered a disposable item to be discarded after a single use. The rotor assembly preferably includes a removable filler piece or center piece formed from a single piece of material, such as rigid plastic, as by molding, dimensioned to form, with the wall of the centrifuge bowl, a circular channel having dimensions appropriate to receive the semirigid container, which is suitably bent and placed in the channel. Fluid connections are provided from each end of the container to an axially located multichannel rotating seal. The connections lie in a plurality of radial slots in the filler piece. Alternatively the entire assembly may be molded as a single entity, with a suitable channel and fluid line grooves being cast therein.

19 Claims, 4 Drawing Figures

CENTRIFUGE ASSEMBLY

BACKGROUND OF THE INVENTION

Previous centrifuges for separating the components of blood are known in which the centrifuge bowl is reusable, and is provided with relatively complex channeling or grooves, and fluid connections, making the device expensive and difficult to clean and sterilize for each use.

DESCRIPTION OF THE PRIOR ART

The present invention provides an improved centrifuge bowl and container assembly for use with blood cell separators of the type shown, for example, in U.S. Pat. No. 3,489,145. In this prior arrangement, a solid centrifuge element was used, having appropriate channels cast or machined therein, and did not contemplate reusable bags. Bag structures not requiring channeled support elements are disclosed in U.S. Pat. Nos. 3,748,101 and 4,007,871. However, such arrangements are not as efficient or economically manufactured as the subject invention. None of this art or other known prior art provides a centrifuge assembly comprising a solid reusable rigid center element arranged to provide a conformed channel for a disposable tube of semirigid material, having fluid connections to appropriate ends thereof.

SUMMARY OF THE INVENTION

It is a general object of this invention to provide an improved rotor assembly for a centrifuge.

Another object of the invention is to provide an improved rotor assembly utilizing a disposable container for centrifuging blood to obtain different fractions therefrom.

A further object of the invention is to provide an improved rotor assembly and associated container for centrifuging blood, which is simple and economical in construction, and the container is disposable after a single use.

The foregoing and other objects, features and advantages of the invention will be apparent from the following more particular description of preferred embodiments of the invention, as illustrated in the accompanying drawings and described in connection therewith in the annexed specification.

Briefly described, the improved assembly provided by this invention comprises a rotor assembly, which in a first embodiment, constitutes a centrifuge bowl and a filler or center piece, which can be removable from the bowl. The center piece and bowl are dimensioned so that an annular channel is formed by the space between the outer circumference of the filler piece and the inner surface of the bowl.

Fitted into this space is a ring-like fluid container comprising a tube having a rectangular or substantially rectangular cross section, closed at both ends, and provided with a plurality of fluid connections or inlet and outlet tubes. These tubes, together with a suitable rotating seal, permit the introduction of whole blood into the container and the withdrawal of blood fractions following centrifugal separation. The fluid container and the tubing connections may be formed of medical grade polyvinyl chloride.

In another embodiment, the entire rotor assembly is made in one piece by molding and/or machining, with an appropriate circular channel formed in the rotor.

BRIEF DESCRIPTION OF THE DRAWINGS

In the drawings.

Similar reference characters refer to similar parts in each of the several views.

DETAILED DESCRIPTION OF PREFERRED EMBODIMENTS

Figure 1:
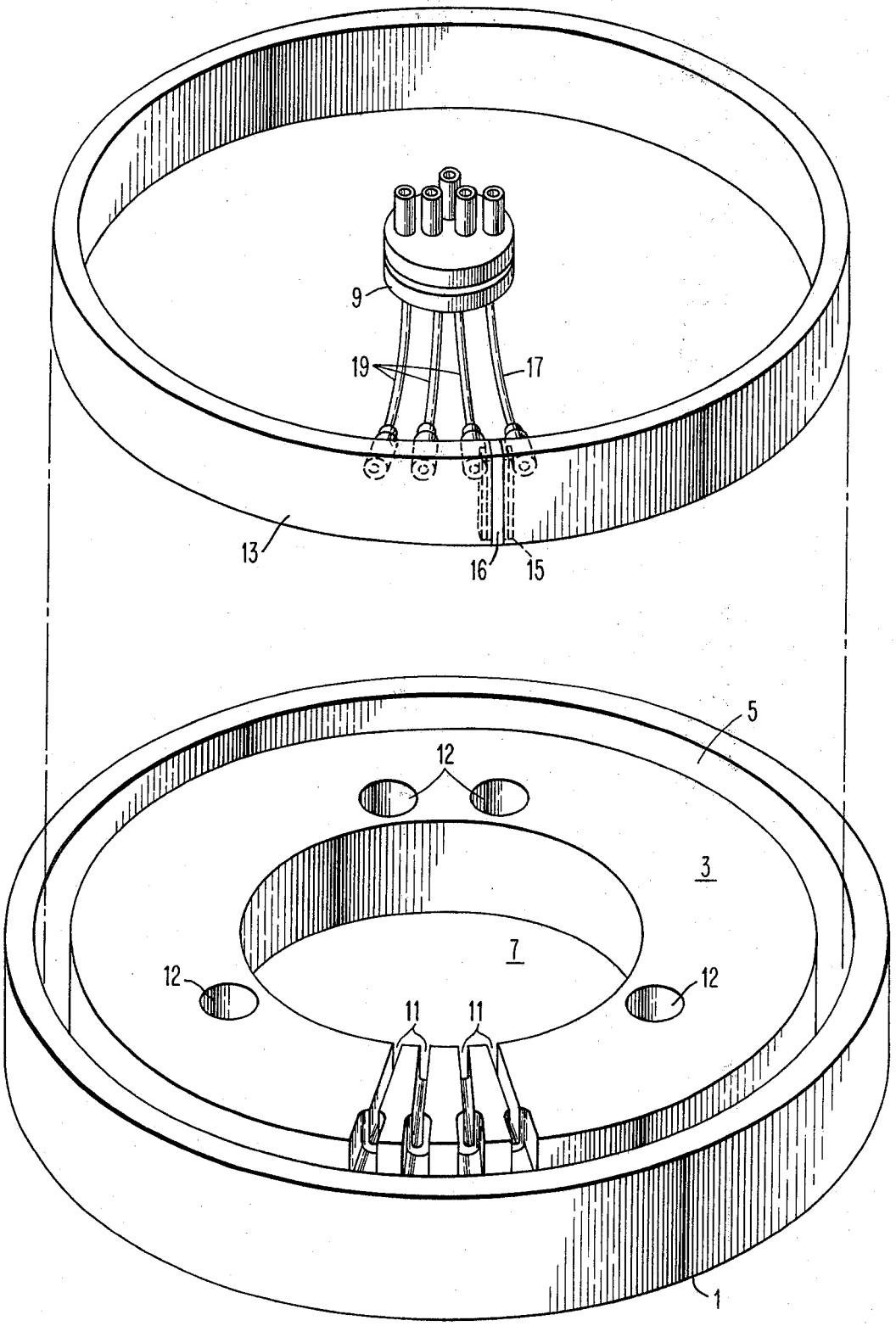
FIG. 1 is a diagrammatic perspective view showing a centrifuge bowl, a filler or center piece, and a fluid container in an exploded relation in accordance with one preferred form of the invention.

Referring to the drawings, there is shown, in FIG. 1, a centrifuge bowl 1, arranged to be spun around an axis of rotation by suitable means, not shown since the specific rotating means is not germane to this invention. The bowl can be formed of any suitable material such as metal or plastic or a combination of materials.

Seated within the bowl 1 is a filler or center piece 3 which can be formed of any suitable material, by molding and/or machining. The filler piece 3 is dimensioned so that when in place in the bowl 1, the filler will be concentric with the bowl. It can be retained in place on a central hub, or a plurality of distributed bosses or pins. The dimensions of the filler piece are selected so that when the filler piece is in place in the bowl, a circular channel 5 the depth of the bowl will exist between the outer circumference of the filler piece and the inner circumference of the bowl. The filler piece 3 has a central hole or opening 7 which accommodates the fluid connections to the fluid container, to be subsequently described, and a rotating seal 9. Also the opening may be dimensioned to fit over a central hub in the bowl, to accurately locate and retain the filler piece. The seal may be of the type shown in U.S. Pat. No. 3,489,145, for example. Filler piece 3 also has a plurality of radial slots 11 in the upper portion of the piece, which receive the fluid connections or tubes to the container. Additional openings 12 are provided to not only provide dynamic balance of piece 3, but also to serve as finger grips for lifting piece 3 into and out of the bowl 1.

The fluid container comprises a length of semi-rigid plastic tubing 13, preferably of medical grade polyvinyl chloride, and having a substantially rectangular cross section. The tubing is formed in a circular or ring-like shape as shown, and the ends joined together, as by a connector piece 15 to which the ends of the tubing are cemented. The connector includes a barrier or wall 16, to isolate one end of the chamber from the other end. Fluid connections to the container are provided by a plurality of tubing connections 17 and 19, one of which (17) serves as an input connection, and the remainder (19) serve as output connections between the container 13 and the rotating seal 9. When the container 13 is placed in channel 5, the tubes 17 and 19 are placed in the appropriate slots 11 in filler piece 3.

Figure 2:
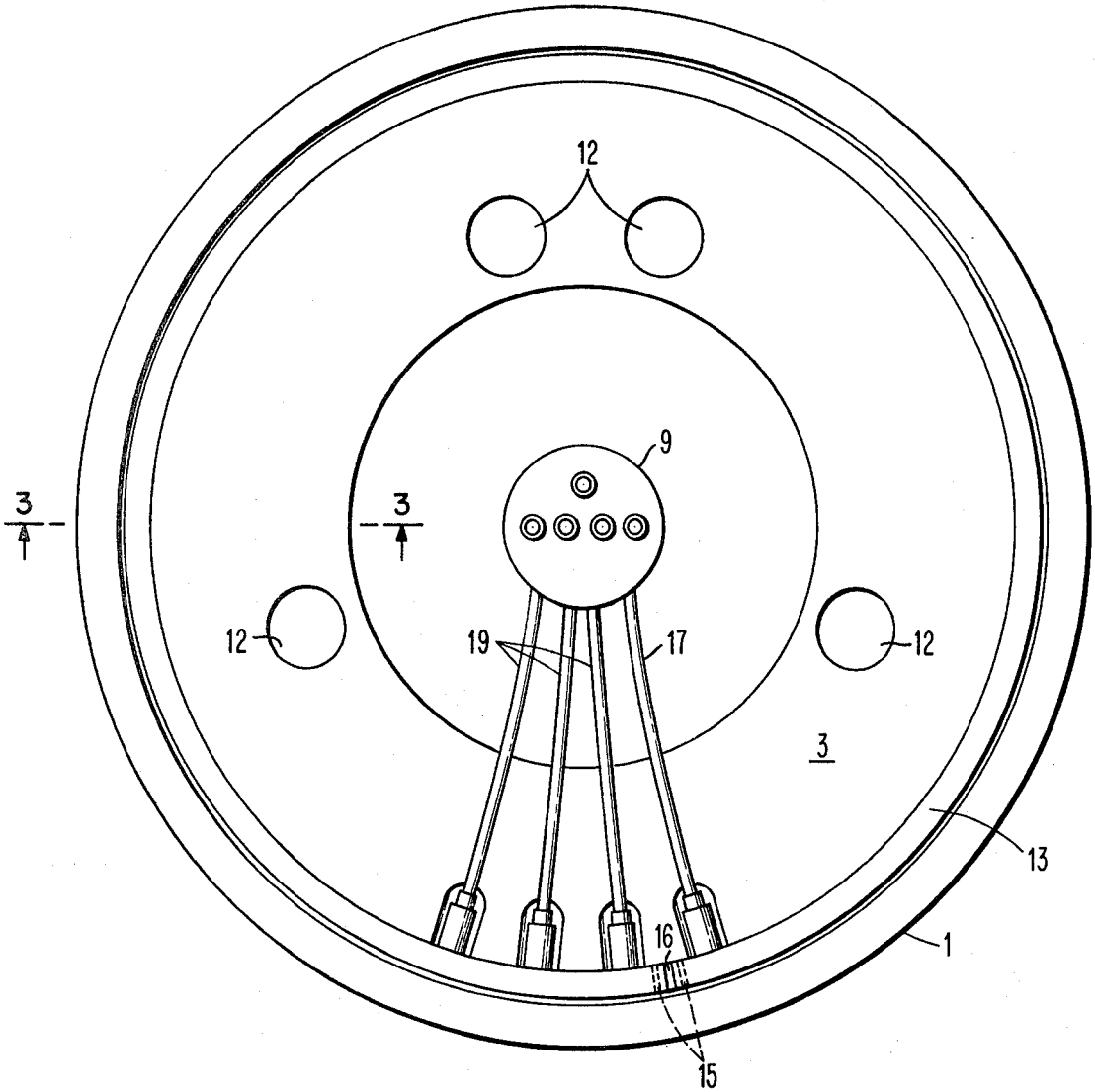
FIG. 2 is a diagrammatic plan view of the assembly shown in FIG. 1.

FIG. 2 is a plan view of the assembly shown in FIG. 1, and further shows the relationship between the various ports. The relationships are manifest from this figure.

Figure 3:
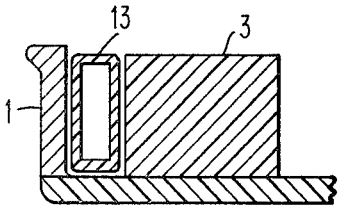
FIG. 3 is a sectional elevational view of the assembly of FIG. 2 taken at the section 3—3.

FIG. 3 is a cross-sectional elevation view taken along the section line 3—3 in FIG. 2. The manner in which the container 13 rests in the channel formed between the filler piece 3 and the centrifuge bowl wall 1 is clearly seen.

Figure 4:
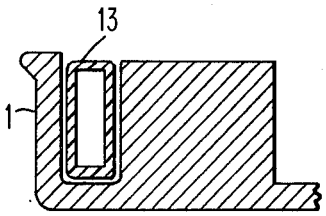
FIG. 4 is a diagrammatic cross section elevation view of a centrifuge assembly using a one-piece rotor, in accordance with another preferred embodiment of the invention.

It will be readily apparent to those skilled in the art that the embodiment described above provides an assembly in which a plurality of filler pieces could be interchangeably utilized in the same centrifuge bowl, including the one described above. If such interchangeability is undesirable or unnecessary, a one-piece rotor may be used, forming, with the container, another preferred embodiment of the invention. Such a structure will be apparent from the cross-sectional view shown in FIG. 4, showing how the bowl and center piece can be formed from one piece of material, either by molding or machining.

From the foregoing, it will be apparent that the present invention provides a novel centrifuge assembly which is advantageous from the standpoint of being economical to fabricate and includes a low cost simple disposable fluid container to be discarded after a single use, thereby removing the expensive duties of cleaning and sterilizing required with reusable centrifuge containers.

While the invention has been particularly shown and described with reference to several preferred embodiments thereof, it will be understood by those skilled in the art that various changes in form and details may be made therein without departing from the spirit and scope of the invention.

We claim:

1. A centrifuge assembly comprising a rotor bowl, a circular filler piece received in said bowl and providing a space between the circumference of said filler piece and the inner wall of said bowl, the space between said filler piece and the wall of the bowl defining a circular channel in said assembly, a disposable ring-like container of semirigid material having a substantially rectangular cross section contained in and conforming to said channel and having two ends, fluid connections to each end of said elongated container, and guide means for said fluid connections.

2. A centrifuge assembly as claimed in claim 1, in which said fluid connections comprise an inlet connection to one end of said container, and at least two output connections to the other end of said container.

3. A centrifuge assembly as claimed in claim 1 in which said container is formed from medical grade polyvinyl chloride.

4. A centrifuge assembly as claimed in claim 1 wherein said guide means comprise a plurality of radial slots in said filler piece spaced to receive said fluid conections.

5. A centrifuge assembly comprising a rotor bowl, a circular filler piece received in said bowl and providing a space between the circumference of said filler piece and the inner wall of said bowl, the space between said filler piece and the wall of said bowl defining a circular channel in said assembly, said channel having a rectangular cross section, a disposable ring-like container of semirigid material contained in and conforming to said channel, said container having two ends and having a substantially rectangular cross section corresponding to the cross section of said channel, fluid connections to each end of said container, and guide means for said fluid connections.

6. A centrifuge assembly as claimed in claim 5, in which the ends of said container are joined by a connector piece.

7. A centrifuge assembly as claimed in claim 6, in which said connector piece includes a barrier to isolate one end of said container from the other end.

8. A centrifuge assembly as claimed in claim 7, in which an input fluid connection is provided at one end of said container, and a plurality of output connections are provided at the other end of said container.

9. For use in a centrifuge device having an axis of rotation and including a bowl rotatable about said axis and containing a channel at least a portion of which is substantially arcuate with respect to said axis, a blood component separating receptacle comprising an elongated disposable container corresponding to the cross-section of said channel adapted to be contained in and to conform to said channel during centrifuging, an inlet post positioned near a first end of said container for admission of blood to be separated, and an outlet port positioned near a second end of said container for removal of blood components, fluid connections for said inlet and outlet ports and, guide means for said fluid connections.

10. For use in a centrifuge device having an axis of rotation and including a bowl having walls defining a substantially arcuate-shaped slot, a blood component separating receptacle comprising:

an elongated sealed container having a length dimension which is larger than any dimension of its cross-section by at least a factor of ten and said container being adapted to interfit in said arcuate slot, an inlet port positioned near a first end of said container, an outlet port positioned near the other end of said container, fluid connections for said inlet and outlet ports, and guide means for said fluid connections.

11. For use in a centrifuge device having an axis of rotation and including a bowl having walls defining a substantially arcuate-shaped slot, a blood component separating receptacle comprising:

an elongated sealed container having a length dimension which is larger than any dimension of its cross-section by at least a factor of about 30 and said container being adapted to interfit in said arcuate slot, an inlet port positioned near a first end of said container, and an outlet port positioned near the other end of said container, fluid connections for said inlet and outlet ports, and guide means for said fluid connections.

12. For use in a centrifuge device having an axis of rotation and including a bowl rotatably about said axis and containing a channel of substantially rectangular cross-section at least a portion of which is substantially arcuate wih respect to said axis, a blood component separating receptacle comprising:

an elongated disposable container of substantially rectangular cross-section corresponding to the cross-section of said channel adapted to be contained in and conform to said channel during centrifuging, an inlet port positioned near a first end of said container for admission of blood to be separated, and an outlet port positioned near a second end of said container for removal of blood component, fluid connections for said inlet and outlet ports, and guide means for said fluid connections.

13. A centrifuge assembly comprising a rotor, means providing a two portion channel in said rotor, a first portion of said channel being circular-like and having a constant radius extending from the true center of said rotor, and a second portion of said channel being spiral-like a disposable elongated container of semi-rigid material contained in and conforming to said channel, and fluid connections to each end of said elongated container.

14. A centrifuge assembly comprising a rotor, means providing a two portion channel in said rotor, a first portion of said channel being circular-like and having a constant radius extending from the true center of said rotor, and a second portion of said channel being spiral-like a disposable elongated container contained in said channel, and fluid connections to each end of said elongated container.

15. A centrifuge assembly comprising a rotor bowl, a circular member located in said bowl and providing a space between the circumference of said member and the inner wall of said bowl, the space between said member and the wall of the bowl defining a circular channel in said assembly, and a removable ring-like container of semirigid material having a substantially rectangular cross section container in and conforming to said channel and having two ends, and fluid connections to each end of said container.

16. A centrifuge assembly comprising a rotor bowl, a circular member located in said bowl and providing a space between the circumference of said member and the inner wall of said bowl, the space between said member and the wall of the bowl defining a circular channel in said assembly, and a removable ring-like container of semirigid material having a substantially rectangular cross-section contained in and conforming to said channel and having two ends, fluid connections to each end of said container, and guide means for said fluid connections.

17. A centrifuge assembly comprising a rotor bowl, a circular channel defined in said bowl between the outer circumference and an inner wall thereof, a disposable ring-like container of semi-rigid material having a substantially rectangular cross section contained in and conforming to said channel and having two ends, fluid connections to each end of said elongated container, and guide means for said fluid connections.

18. A centrifuge assembly comprising a rotor bowl, said bowl having therein a circular channel defined between the outer circumference of said bowl and an inner wall thereof, and a removable ring-like container of semirigid material having a substantially rectangular cross section contained in and conforming to said channel and having two ends, fluid connections to each end of said container, and guide means for said fluid connections.

19. A centrifuge assembly comprising a rotor bowl, said rotor bowl having a circular channel therein, said channel defined between the outer circumference of said bowl and an inner wall thereof, said circular channel having a rectangular cross section, a disposable ring-like container of semirigid material contained in and conforming to said channel, said container having two ends and having a substantially rectangular cross section corresponding to the cross section of said channel, fluid connections to each end of said container, and guide means for said fluid connections.

* * * * *

UNITED STATES PATENT AND TRADEMARK OFFICE

CERTIFICATE OF CORRECTION

PATENT NO. : 4,430,072

DATED : February 7, 1984

INVENTOR(S) : Robert M. Kellogg et al.

It is certified that error appears in the above-identified patent and that said Letters Patent is hereby corrected as shown below:

Column 5, lines 5-35 should be deleted. (Deleting Claims 13, 14 and 15).

On the title page "19 Claims" should read -- 16 Claims --.

Signed and Sealed this

*Fourteenth* Day of *August 1984*

[SEAL]

*Attest:*

GERALD J. MOSSINGHOFF

*Attesting Officer*

*Commissioner of Patents and Trademarks*